US006427440B1

(12) United States Patent
Bonny et al.

(10) Patent No.: US 6,427,440 B1
(45) Date of Patent: Aug. 6, 2002

(54) BUILT-UP AIRGAP-INSULATED EXHAUST MANIFOLD OF A MOTOR VEHICLE AND METHOD FOR PRODUCING IT

(75) Inventors: Pierre Bonny, Hamburg; Thomas Hulsberg, Buchholz, both of (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 09/574,615

(22) Filed: May 18, 2000

(30) Foreign Application Priority Data

May 21, 1999 (DE) ..... 199 23 557

(51) Int. Cl.[7] ..... F01N 7/10
(52) U.S. Cl. ..... 60/323; 60/321; 60/322
(58) Field of Search ..... 60/321, 323

(56) References Cited

U.S. PATENT DOCUMENTS

| | | | | | |
|---|---|---|---|---|---|
| 4,091,616 | A | * | 5/1978 | Loweg | 60/295 |
| 4,182,122 | A | * | 1/1980 | Stratton et al. | 60/323 |
| 5,167,934 | A | * | 12/1992 | Wolf et al. | 60/274 |
| 5,331,810 | A | * | 7/1994 | Ingermann et al. | 60/322 |
| 5,349,817 | A | * | 9/1994 | Bekkering | 60/323 |
| 5,419,127 | A | * | 5/1995 | Moore, III | 60/323 |
| 5,495,873 | A | * | 3/1996 | Butkiewicz et al. | 138/114 |
| 5,572,867 | A | * | 11/1996 | Bekkering et al. | 60/305 |
| 5,682,741 | A | * | 11/1997 | Augustin et al. | 60/323 |
| 5,689,954 | A | * | 11/1997 | Blocker et al. | 60/323 |
| 5,697,155 | A | * | 12/1997 | Bloecker et al. | 29/890.148 |
| 5,729,975 | A | * | 3/1998 | Bekkering | 60/323 |
| 5,761,905 | A | * | 6/1998 | Yamada et al. | 60/323 |
| 5,768,890 | A | * | 6/1998 | Bekkering et al. | 60/305 |
| 5,784,882 | A | * | 7/1998 | Bonny et al. | 60/323 |
| 6,134,886 | A | * | 10/2000 | Busssmann et al. | 60/323 |
| 6,247,552 | B1 | * | 6/2001 | Kovar et al. | 60/323 |

FOREIGN PATENT DOCUMENTS

| | | |
|---|---|---|
| DE | 43 39 290 C2 | 11/1995 |
| DE | 44 44 760 A1 | 6/1996 |
| DE | 195 11 514 C1 | 8/1996 |
| DE | 195 32 068 A1 | 3/1997 |
| DE | 196 42 692 A1 | 4/1998 |
| DE | 197 52 773 C2 | 9/1999 |

* cited by examiner

*Primary Examiner*—Thomas Denion
*Assistant Examiner*—Diem Tran
(74) *Attorney, Agent, or Firm*—Crowell & Moring LLP

(57) ABSTRACT

A built-up airgap-insulated exhaust manifold of an exhaust system of a motor vehicle includes at least two exhaust pipes with an inlet flange attached in each case to one end and to be fastened to the cylinder head of an internal combustion engine of a motor vehicle. The exhaust pipes include a pipe bend and at least one branched pipe piece connected to the latter. If a plurality of branched pipe pieces are arranged they are connected to one another in a row and the last pipe piece in the row forms a header connected at one end to the exhaust tract leading further on in the exhaust system. The exhaust manifold has at least one exhaust pipe, which is designed as a double pipe with airgap insulation between an outer and an inner pipe, and possessing at least one exhaust pipe without an air insulation gap. The outer pipe and the inner pipe of the airgap-insulated exhaust pipe bear against one another at the end which is plugged together with and welded to an associated inlet flange.

12 Claims, 3 Drawing Sheets

BUILT-UP AIRGAP-INSULATED EXHAUST MANIFOLD OF A MOTOR VEHICLE AND METHOD FOR PRODUCING IT

BACKGROUND OF THE INVENTION

1. Field of the Invention

The invention relates to a built-up airgap-insulated exhaust manifold of an exhaust system of a motor vehicle and to a method for producing it.

2. Description of Prior Developments

A built-up airgap-insulated exhaust manifold is known, for example, from DE 195 11 514C1. This reference describes the manufacture of an exhaust manifold which consists of a plurality of inner pipes plugged with a sliding fit one into the other, of an outer casing and of inlet flanges and an outlet flange. The outer casing is produced with a semimonocoque design. First, the plugged-together assembly of the inner pipes (pipe bend, T-piece and branched pipe with connection to the outlet flange) is inserted into a lower outer-casing half-shell. Then, the upper half-shell is pressed onto the lower half-shell and welded to the lower half-shell so as to form a beading seam between the inner-pipe ends.

The plugged-together assembly of the inner pipes is centered within the outer casing in a complicated way by means of special spacer rings which are pushed onto a plurality of inner pipes, the gap which at the same time occurs forming the subsequent air insulation gap. The spacer rings consist of a material which decomposes and/or sublimates under the action of heat, in particular when the engine is in operation. The individual pipes are subject to manufacturing tolerances and are displaceable relative to one another. Because of the work involved in fixing the plugged-together assemblies to one another, the assemblies have different "plugging" lengths. The spacer rings are themselves subject to manufacturing tolerances and as a result of their shape in relation to the design of the lower shell, seldom come to bear continuously against the latter. For these reasons alone the manufacture of the entire exhaust manifold is affected by tolerances.

In view of the manufacturing tolerances mentioned, the inner pipe having the branch connection piece virtually never lies within the outer casing with the desired defined continuous airgap. Accurate reproducibility does not exist in this case.

At the same time, it is necessary, during assembly, to ensure that a specific minimum plugging length is adhered to, so that the individual inner pipes do not slip out of one another. This adherence necessitates judgment by the eye and therefore considerable effort. During the transfer of parts to the welding station, vibrations and centrifugal forces may also occur, which cause the individual inner pipes once again to be displaced relative to one another and to the lower shell of the outer casing, and this may even lead to the plugged-together assembly coming loose.

Due to the rebound distortion of the two sheet-metal half-shells after deep-drawing, the two outer-casing half-shells do not by themselves bear against one another in a continuously snug and gap-free manner. In the welding station, therefore, the upper shell of the outer casing is placed onto the lower shell and is pressed against this. In this case, too, there are vibrations of the plugged-together assembly or displacement at the relative position of the branched inner pipe in the outer casing.

Finally, the shells of the outer casing are laser-welded to one another. After the applied pressure has been cancelled, considerable tensile forces then act on the weld seam because of the non-uniformity of the bearing faces of the half-shells. This lowers the permanent load-bearing capacity of the assembly as a whole, in particular of the outer casing, and may even lead to a failure of the structural part when the exhaust tract is in operation. Thus, overall, process reliability in the production of the exhaust manifold is not ensured to a sufficient extent.

The welding together of the half-shells so as to form a beading seam is also relatively complicated, particularly since a triangular gusset occurs, because of edge radii, at the transition to the cutout of the outer casing for the branched connection piece of the inner pipe. This gusset has to be welded shut for process reliability, and in practice, can be done in an appropriate way only with the aid of an additional material. Moreover, the beading seam, because of its configuration, has a limited mechanical load-bearing capacity. For fixing the inner pipe to outer casing, additional welding is necessary, so as to form a round seam. That is, to form a continuous fillet seam in the end region of the branch connection piece. The end of the inner pipe of the connection piece is set back somewhat relative to the orifice of the outer casing.

Because of the branched exhaust pipe, the outer casing is designed with a very long spatial projecting length, since the production of the half-shells by deep-drawing means that a branch cannot be achieved and it is therefore unsuitable for designing an outer casing with a contour true to the configuration of the inner pipe. All the inner pipes are, in this case, surrounded integrally by a single common outer casing, thus resulting, because of the uniform termination of the outer casing approximately in the plane of the inlet flanges, in relatively large-volume sheet-metal portions of the outer casing. These large volume portions occur between the inner pipes adjoining the inlet flanges and require considerable construction space, increase the weight of the branched exhaust pipe and entail additional unnecessary outlay in terms of material. Moreover, it is consequently not possible to produce a defined evenly uniform airgap at the branched exhaust pipe.

Furthermore, engines having different numbers of cylinders require exhaust manifolds which are designed differently on account of the outer casing. This signifies a high additional outlay in terms of manufacture and tooling, along with the corresponding costs. Likewise, for differently designed construction spaces, new variants in the semimonocoque design of the exhaust manifold, which are adapted to these construction spaces, have to be invented. Implementing this likewise necessitates a considerable outlay in manufacturing terms.

SUMMARY OF THE INVENTION

The object on which the invention is based is to provide an airgap-insulated exhaust manifold which saves construction space and weight, and to provide a production method for this, by means of which a process-reliable and exactly reproducible design of the exhaust manifold can be achieved in a simple way.

The invention makes it possible to have a modular design of the exhaust manifold, in which exhaust manifolds configured in any desired way in terms of their extent and overall depth can be manufactured in the simplest possible way from airgap-insulated individual exhaust pipes plugged one into the other, with the outer pipes of the individual exhaust pipes being welded to one another and the inner pipes being positioned with a sliding fit one in the other. The individual modules form the individual exhaust pipes which constitute standard structural elements and therefore mass articles capable of being produced cost-effectively. Thus, simply by joining together identical parts of the branched exhaust pipes, it is possible, for example from a four-cylinder exhaust manifold, to produce a 6-cylinder or 8-cylinder exhaust manifold.

The entire assembly operation is simplified substantially by the use of identical parts. Since the individual exhaust pipes are manufactured by means of internal high-pressure forming, this avoids any manufacturing tolerances which result from inner pipes located in the plugged-together assembly being displaced during the individual assembling and joining steps, so that any desired exhaust manifold can be reproduced exactly. The lack of an integral outer casing and the fastening of outer-casing half-shells to one another and of the outer casing to the inlet flanges mean that the difficulties caused by mechanical and thermal stresses in the weld seams hitherto necessary are avoided.

Since the outer pipe is designed with a contour true to the run of the inner pipe or its shape by means of a double pipe formed by internal high pressure into an airgap-insulated exhaust pipe, superfluous material of the outer pipe is avoided, in contrast to the outer casing of the semimonocoque design, and the construction space is thereby also reduced. Overall, the design of the exhaust manifold can be adapted flexibly to the shape of the construction space provided, since the individual exhaust pipes of the manifold can follow the run of the construction space by being suitably lined up with one another.

By contrast, the exhaust manifold in the semimonocoque design would be so bulky, because the pipes carrying exhaust gas run into the depth of the construction space, that installation is impossible from the outset. Furthermore, by the exhaust pipes being manufactured by means of internal high-pressure forming, the air insulation gap can be set in a controlled manner, and everywhere uniformly, over the entire extent of the exhaust pipe.

The points where the outer pipes are joined to one another are welded together, preferably by means of a laser, so as to form a continuous fillet weld seam having very high mechanical load-bearing capacity. Overall, high process reliability is achieved by means of the production method according to the invention, since, by virtue of the internal high-pressure forming, there is no possibility of displacing the inner pipes so as to cause the plugged-together assemblies to become loose and, the number of weld seams is minimized. The exhaust manifold is configured in such a way that only continuous fillet seams, which are simple to execute and are capable of being subjected to mechanical stress, are necessary for fastening the individual exhaust pipes to one another and to the inlet flanges and the outlet flange.

In the airgap insulation of the exhaust pipes, there is no need for the pipe bend to be formed by internal high pressure, this being advantageous in terms of tooling. Furthermore, the partial airgap insulation of the exhaust manifold affords advantages due to the essentially simpler production of the individual exhaust pipes which are free of an air insulation gap. The reduction in complexity of the design of the exhaust pipes brings about a further improvement in process reliability. The exhaust pipes free of an air insulation gap can, of course, be used only where there are no heat-sensitive parts of the motor vehicle arranged in the immediate vicinity. Moreover, because the second pipe is dispensed with in a single-walled exhaust pipe free of an air insulation gap, the exhaust manifold is substantially lighter and also requires less construction space.

BRIEF DESCRIPTION OF THE DRAWINGS

Expedient refinements of the invention may be gathered from the subclaims; moreover, the invention is explained in more derail below with reference to an exemplary embodiment illustrated in the drawings, in which:

DETAILED DESCRIPTION OF THE PREFERRED EMBODIMENTS

Figure 1:
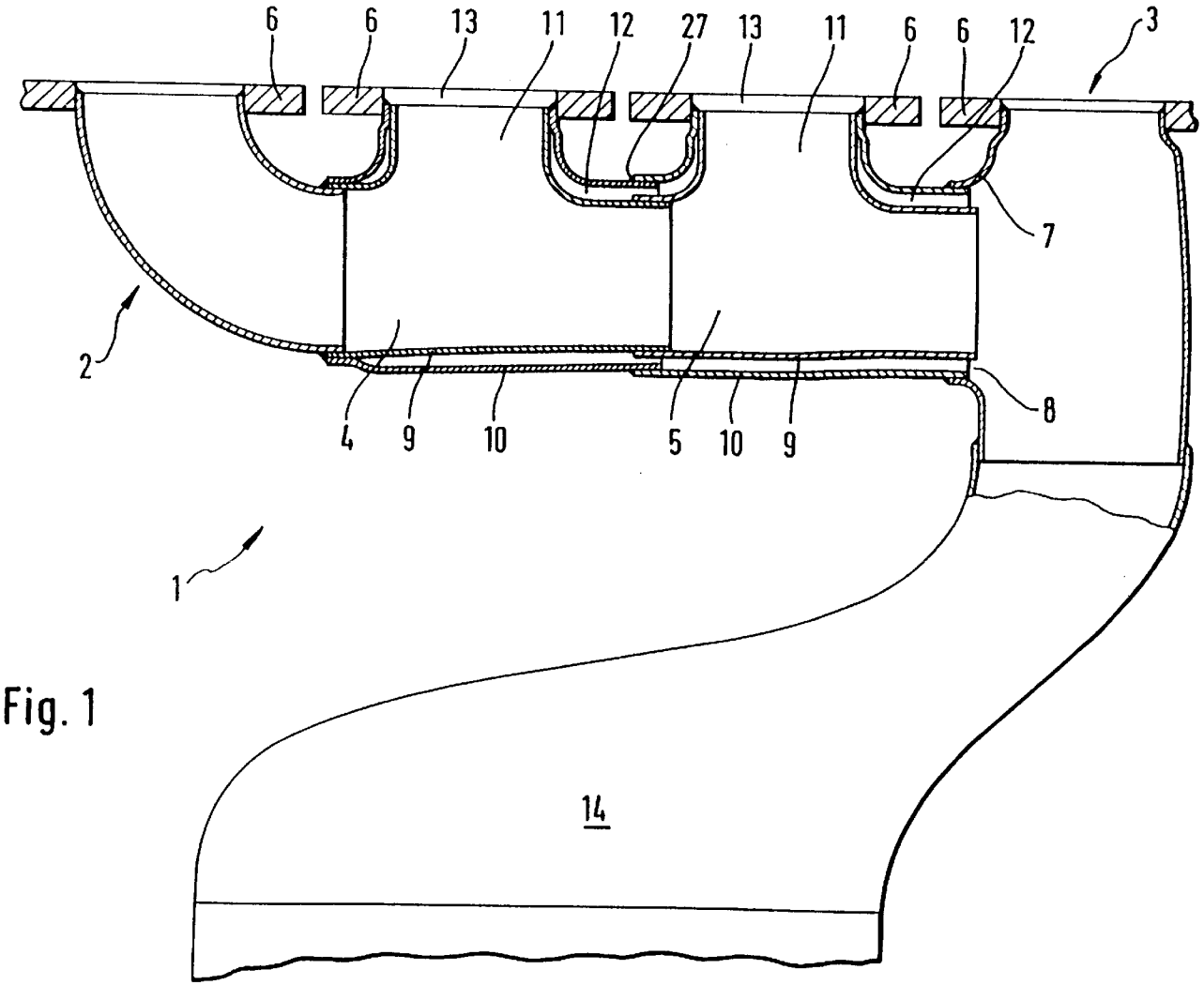
FIG. 1 shows, in lateral section, the exhaust manifold according to the invention with a connected catalyst scoop and with an uninsulated pipe bend and header.

FIG. 1 illustrates an exhaust manifold 1 which includes a pipe bend 2, a branched header 3 and two branched exhaust pipes, the T-pipe pieces 4 and 5, which are located between them. The four exhaust pipes 2, 3, 4, 5 are plugged at one of their ends into individual inlet flanges 6 and welded to these. The inlet flanges 6 are fastened to a cylinder head of an internal combustion engine. The pipe bend 2 and the header 3 are each formed by a single pipe which has no air gap insulation.

The header 3 may be produced by the internal high-pressure forming of a rectilinear pipe, the branch 7 of which is at the same time blown out. The branch 7 is subsequently trimmed in the cap region so as to open a passage 8. The T-pipe pieces 4 and 5 are designed as double pipes formed by two rectilinear pipes, an inner pipe 9 and an outer pipe 10, being plugged one into the other. In a first forming step, a double-walled branch connection piece 11 is shaped out from these rectilinear double pipes in a forming tool with internal high pressure by internal fluid high pressure and, in a second subsequent forming step, an air insulation gap 12 also surrounding the branch connection piece 11 is produced.

As a result of the fluid high pressure and the tool die configuration, the inner pipe 9 is clamped together with the outer pipe 10 at both ends and circumferentially in the cap region of the branch connection piece 11. Subsequently, a double-walled cap portion is detached from the end of the branch connection piece 11, while at the same time the clamping between the inner pipe 9 and outer pipe 10 is maintained, a passage orifice 13 outwards from the inner pipe 9 is obtained. The end of the branch connection piece 11 is then plugged together with the inlet flange 6 of the exhaust manifold 1 and welded.

Those ends of the branched airgap-insulated exhaust pipes 4 and 5 which are to be connected to one another are first trimmed, so as to open the respective air insulation gap 12, and are then plugged one into the other, the ends being shaped in such a way that the plug connections of the outer pipes 10 and of the inner pipes 9 of the exhaust pipes to be connected are made with play. Those outer-pipe ends of the exhaust pipes which are to be plug-connected to one another are welded together at the point of their plug connection, so as to form a continuous fillet seam 27, while the inner pipes 9 are arranged with a sliding fit one against the other.

At that end of the T-pipe piece 4 which faces the pipe bend 2, the air insulation gap remains unopened, that is to say no trimming is carried out at this end. The pipe bend 2 is plugged into the inner pipe 9 of the T-pipe piece 4 and is welded to the inner pipe 9 and outer pipe 10 of this T-pipe piece 4. In order to compensate the thermal stresses which may occur when the engine is in operation, it is provided for the flanges to slide on the sealing face of the cylinder head, and this may be implemented by means of a defined tightening torque of the flange nuts.

That end of the T-pipe piece 5 which faces the header 3 is plugged with its outer pipe 10 into the single-walled branch connection piece 7 of the header 3 and welded to the latter. The inner pipe 9 of the T-pipe piece 5 at the same time projects freely into the branch connection piece 7. Moreover, the header is plugged into a catalyst scoop 14 which, here, is likewise of single-walled design. Since the outlet flange usually attached to the header is dispensed with, the catalyst can be arranged very near to the exhaust manifold 1, so that, despite the partial airgap insulation of the exhaust manifold, the catalyst is started up and begins to function more quickly and pollutant emissions are consequently reduced.

Figure 2:
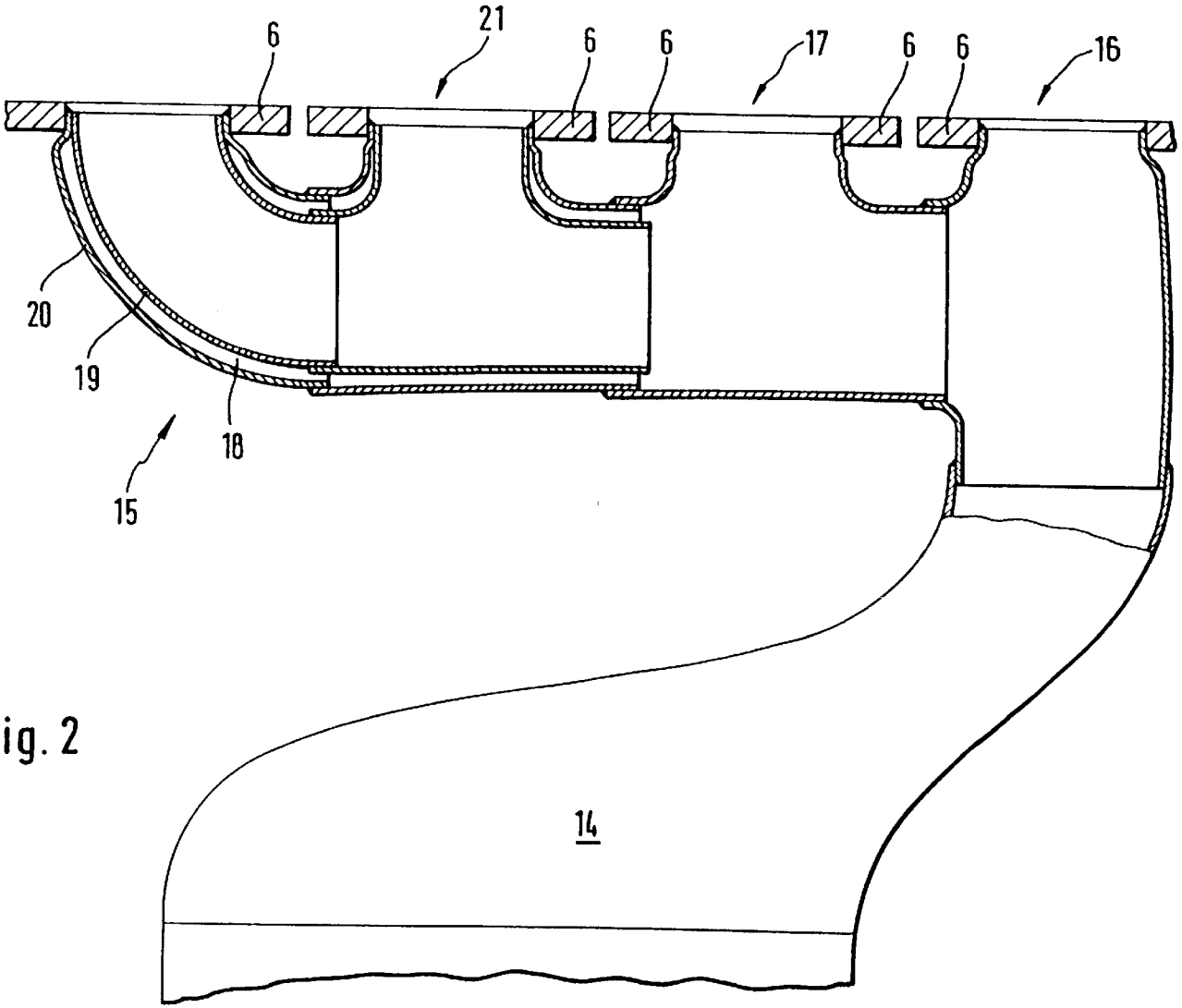
FIG. 2 shows, in lateral section, the exhaust manifold according to the invention with a connected catalyst scoop, with an airgap-insulated pipe bend and with branched exhaust pipes free of an air insulation gap.

FIG. 2 shows a variant of the exemplary embodiment of FIG. 1. In contrast to the latter, the pipe bend 15 is airgap-insulated, and the T-pipe piece 17 connected directly to the header 16 is designed without an air insulation gap. In this case, the airgap 18 of the pipe bend 15 can be produced by the internal high-pressure forming of a bent double pipe. Alternatively, as illustrated here, it is possible to prebend individual pipes which are pushed one into the other, the inner pipe 19 having a diameter dimensioned such that it is spaced circumferentially from the outer pipe 20.

The inner pipe 19 can be positioned in the outer pipe 20 by means of pushed-on spacer rings, after which that end of the outer pipe which faces the inlet flange is reduced in diameter, for example by being rolled down, until it bears against the inner pipe 19.

Alternatively, it is also conceivable, in this case, for the inner pipe 19 to be widened correspondingly, for example by drifting. The pipe bend 15 is then plugged into the inlet flange 6 and welded to the latter. The spacer rings can then be extracted again, after which the pipe bend 15 is plugged together with the nearest airgap-insulated T-pipe piece 21. These are, as before, welded to one another at the outer pipe. The inner pipes are arranged with a sliding fit one against the other. The T-pipe piece 17 without an air insulation gap is plugged, at the other end of the T-pipe piece 21, together with the outer pipe of the latter and welded. The inner pipe of the T-pipe piece 21 then projects freely into the end of the T-pipe piece 17.

Figure 3:
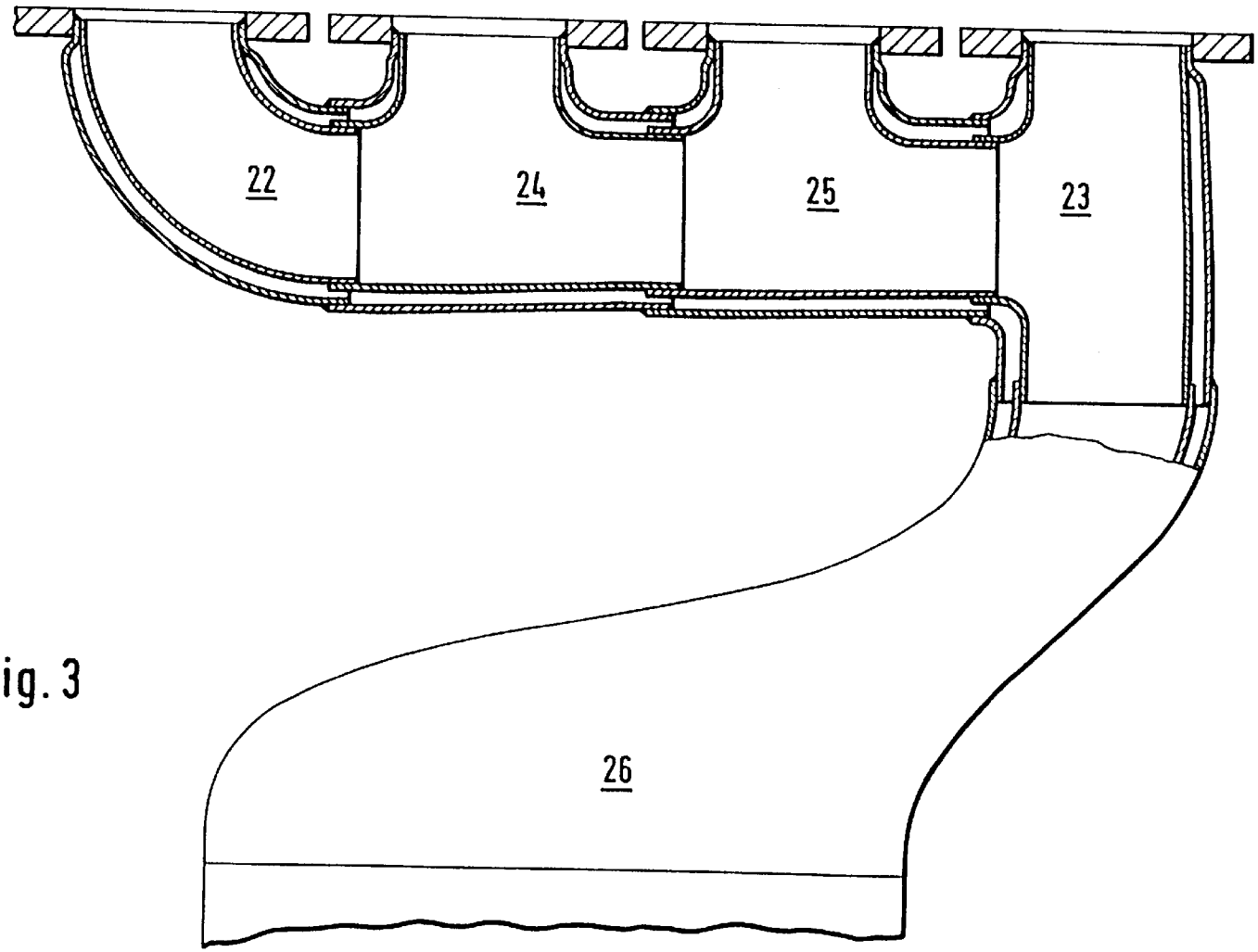
FIG. 3, shows, in lateral section, the exhaust manifold according to the invention with a connected catalyst scoop, entirely airgap-insulated.

A further variant is illustrated in FIG. 3. Here, all the exhaust pipes 22, 23, 24, 25 and, correspondingly, also the catalyst scoop 26 have an airgap-insulated design. As a result of the airgap insulation of the latter, the catalyst begins to function even more quickly and consequently the pollutant emissions are reduced further. The inner pipe of the header 23 produced by internal-high-pressure forming according to the above-described design of the T-pipe pieces is plugged with a sliding fit, at one end, into the T-pipe piece 25 and, at the end facing the catalyst, together with the inner pipe of the catalyst scoop 26. The outer pipes of the T-piece 25, of the header 23 and of the catalyst scoop 26 are correspondingly welded to one another. The pipe bend 22 does not constitute, here, a part formed by internal high pressure and is produced in the way mentioned at the beginning of the exemplary embodiment of FIG. 2.

Instead of the header being connected directly to the catalyst scoop, an outlet flange may also be interposed, to which the header, on the one hand, and the catalyst scoop, on the other hand, are fastened, thus connecting the exhaust manifold to exhaust tract leading further on in the exhaust system.

The outlet flange may have, on the wall of its passage orifice, a concentric widening step which is open towards the header and on which the outer pipe of the header stands. In this case, the outer pipe is welded to the outlet flange. A radially inward annular bead is formed, downstream of the widening step, on the wall of the passage orifice, the inner pipe of the header bearing with a sliding fit against the annular bead. Alternatively, the inner pipe of the header may have a diameter of smaller dimension than the passage orifice of the outlet flange downstream of the widening step, the inner pipe projecting freely into the passage orifice. If the header is airgap-insulated, its end to be plugged together with the outlet flange is trimmed, the air insulation gap being opened on the end face between the inner pipe and outer pipe of the header. The trimmed end is subsequently plugged into the passage orifice of the outlet flange, the outer pipe being received by a concentric widening of the passage orifice and being welded to the outlet flange on the outside, so as to form a continuous fillet seam. The inner pipe of this exhaust pipe is introduced with a sliding fit into the passage orifice simultaneously with the arrangement of the outer pipe in the outlet flange.

It should also be noted, moreover, that, in the case of airgap insulation, the pipe bend is formed, in a first forming step, by the bending of a double pipe.

Furthermore, in the case of the respective branched exhaust pipe to be formed by internal high pressure, in the second forming step the widening of the outer pipe may be carried out in an internal high-pressure forming tool die different from that of the first forming step.

Furthermore, the two ends, terminating flush with one another in the clamping position, of the inner and outer pipes of the respective airgap-insulated exhaust pipe may be plugged into the passage orifice of the inlet flange and firmly connected to the inlet flange by means of a welding operation, preferably by laser welding, so as to form a continuous fillet seam between the passage orifice wall and the end faces of the ends.

Moreover, the inlet-side flange may have a cylindrical extension with surrounds its passage orifice and by means of which it is plugged into the opened air insulation gap of the associated airgap-insulated exhaust pipe. After this, the outer pipe of the respective exhaust pipe is welded to the flange extension on the outside and the inner pipe is welded to the flange extension on the inside, in each case to form a continuous fillet seam.

Furthermore, the branch connection piece of the branched exhaust pipe may be connected to an essentially rectilinear exhaust pipe which is configured according to the design of the branched exhaust pipe in terms of airgap insulation and which is welded at its other end to the inlet flange. However, airgap insulation of the rectilinear exhaust pipe and of the branched exhaust pipe does not have to be provided.

Moreover, the exhaust pipe designed as a pipe bend may be connected at one end to a rectilinear or bent connecting pipe which is connected at the other end to that end of a branched exhaust pipe which faces away from the inlet flange.

Finally, if a plurality of branched exhaust pipes are arranged, these may in each case be connected to one another via a rectilinear or bent connecting pipe.

What is claimed is:

1. An airgap-insulated exhaust manifold of an exhaust system of a motor vehicle, comprising:

at least two exhaust pipes each having an inlet flange attached to one end and to be fastened to a cylinder head of an internal combustion engine of the motor vehicle, the exhaust pipes comprising a pipe bend and at least one branched pipe piece connected to the pipe bend;

at least one exhaust pipe having an inner pipe and an outer pipe, with airgap insulation provided between the inner pipe and outer pipe, the inner pipe and outer pipe formed from rectilinear double pipe by fluid at high pressure so that a gap is formed between the inner pipe and outer pipe, the gap being continuous without obstruction between distal ends of the inner pipe and the outer pipe; and at least one exhaust pipe without an air insulation gap, the outer pipe and the inner pipe of the airgap-insulated exhaust pipe bearing against one another at an end which is plugged together with and welded to the associated inlet flange, at least the exhaust pipe without an air insulation gap being welded at one end to an individual inlet flange, and the exhaust pipe without an air insulation gap, at an end facing away from the inlet flange, being plugged together with and welded to the outer pipe of an airgap-insulated exhaust pipe.

2. The exhaust manifold according to claim 1, wherein at least one branched pipe piece is airgap-insulated and is formed by a fluid with high pressure.

3. The exhaust manifold according to the claim 1, wherein the pipe bend is airgap-insulated.

4. The exhaust manifold according to the claim 3, wherein the pipe bend is formed by fluid with internal high pressure.

5. The exhaust manifold according to claim 1, wherein said pipe piece comprises a header having an outlet flange fastened to one end of the header and connecting the exhaust manifold to an exhaust tract leading further on in the exhaust system.

6. The exhaust manifold according to claim 1, wherein said pipe piece comprises a header directly connected to a catalyst scoop.

7. The exhaust manifold according to claim 6, wherein the catalyst scoop defines an air insulation gap.

8. The exhaust manifold according to claim 1, wherein the exhaust manifold contains a plurality of airgap-insulated inner and outer exhaust pipes which are plugged one into the other in succession, both the outer pipes and the inner pipes being plugged together and, in the plugging position, the outer pipes being welded to one another and the inner pipes being arranged with a sliding fit.

9. The exhaust manifold according to claim 1, wherein the inner pipe of the airgap-insulated exhaust pipe connected to the exhaust pipe without an air gap projects freely into the connecting end of the exhaust pipe without an air gap.

10. A built-up airgap-insulated exhaust manifold of an exhaust system of a motor vehicle, which includes at least two exhaust pipes with an inlet flange attached in each case to one end and to be fastened to the cylinder head of an internal combustion engine of the motor vehicle, the exhaust pipes comprising a pipe bend and at least one branched pipe piece connected to the latter, each of the exhaust pipes being airgap-insulated and, with the exception of the pipe bend, being formed by internal high pressure, the exhaust pipes each being designed as double pipes which include in each case an inner pipe and an outer pipe surrounding the inner pipe with a clearance so that a gap is formed between the inner pipe and the outer pipe, the gap being continuous without obstruction between distal ends of the inner pipe and the outer pipe, the exhaust pipes each having an end plugged together with and welded to the associated inlet flange, and at the plugged ends bear against one another with clamping, and the exhaust pipes, at the ends facing one another, being plugged together, one below the other, both to the outer pipe and to the inner pipe and being welded, one against the other, to the outer pipe, the inner pipes being arranged with a sliding fit one against the other at their ends.

11. An airgap-insulated exhaust manifold of an exhaust system for a motor vehicle, said manifold comprising:

at least two exhaust pipes, each of the pipes having an inlet flange attached to one end and fastened to a cylinder head of an internal combustion engine of the motor vehicle, each of the exhaust pipes comprising a pipe bend and at least one branched pipe piece connected to the pipe bend, the branched pipe piece including a header with an outlet flange fastened to one end of the header and connected to the exhaust tract, the header including an outlet flange having a concentric widening step on the wall of its passage orifice which is open towards the header and on which the outer pipe of the header stands, the outer pipe being welded to the outlet flange with a radially inward annular shaped bead downstream of the widening step, on the wall of the passage orifice, the inner pipe of the header bearing with a sliding fit against the annular bead to form an air-gap insulated header;

at least one exhaust pipe having an inner pipe and an outer pipe, with airgap insulation provided between the outer and inner pipes; and at least one exhaust pipe without an air insulation gap, the outer pipe and the inner pipe of the airgap-insulated exhaust pipe bearing against one another at an end which is plugged together with and welded to the associated inlet flange, at least the exhaust pipe without an air insulation gap being welded at one end to an individual inlet flange, and the exhaust pipe without an air insulation gap, at an end facing away from the inlet flange, being plugged together with an welded to the outer pipe of an airgap-insulated exhaust pipe.

12. An airgap-insulated exhaust manifold of an exhaust system for a motor vehicle, said manifold comprising:

at least two exhaust pipes each having an inlet flange attached to one end and to be fastened to a cylinder head of an internal combustion engine of the motor vehicle, each of the exhaust pipes comprising a pipe bend and at least one branched pipe piece connected to the pipe bend, the branch pipe piece including a header with an outlet flange fastened to one end of the header and connected to the exhaust tract, the header including an outlet flange having a concentric widening step on the wall of its passage orifice which is open towards the header and on which the outer pipe of the header stands, the outer pipe being welded to the outer flange, and the inner pipe of the header having a smaller diameter than the passage orifice of the outlet flange downstream of the widening step, the inner pipe projecting freely into the passage orifice;

at least one exhaust pipe having an inner pipe and an outer pipe, with airgap insulation provided between the outer and inner pipes; and at least one exhaust pipe without an air insulation gap, the outer pipe and the inner pipe of the airgap-insulated exhaust pipe bearing against one another at an end which is plugged together with and welded to the associated inlet flange, at least the exhaust pipe without an air insulation gap being welded at one end to an individual inlet flange, and the exhaust pipe without an air insulation gap, at an end facing away from the inlet flange, being plugged together with and welded to the outer pipe of an airgap-insulated exhaust pipe.

* * * * *